US011079177B2

(12) United States Patent
Gao et al.

(10) Patent No.: US 11,079,177 B2
(45) Date of Patent: Aug. 3, 2021

(54) SKID-MOUNTED COLD BOX AND ITS PREFABRICATED STRUCTURE AND ASSEMBLY METHOD

(71) Applicant: L'Air Liquide, Societe Anonyme pour l'Etude et l'Exploitation des Procedes Georges Claude, Paris (FR)

(72) Inventors: Chenxi Gao, Zhejiang (CN); Remy Kurtz, Zhejiang (CN); Alain Briglia, Zhejiang (CN); Jia Ding, Zhejiang (CN)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 169 days.

(21) Appl. No.: 16/474,121

(22) PCT Filed: Dec. 30, 2016

(86) PCT No.: PCT/CN2016/113663

§ 371 (c)(1),
(2) Date: Jun. 27, 2019

(87) PCT Pub. No.: WO2018/120091

PCT Pub. Date: Jul. 5, 2018

(65) Prior Publication Data

US 2019/0353422 A1 Nov. 21, 2019

(51) Int. Cl.
*F25J 3/04* (2006.01)
*E04B 1/348* (2006.01)
(Continued)

(52) U.S. Cl.
CPC ..... *F25J 3/04945* (2013.01); *B65D 71/0092* (2013.01); *B65D 90/16* (2013.01);
(Continued)

(58) Field of Classification Search
None
See application file for complete search history.

(56) References Cited

U.S. PATENT DOCUMENTS 3,648,990 A * 3/1972 Stoker ..... E04H 5/12 261/109
4,331,252 A 5/1982 Carren et al.
(Continued)

FOREIGN PATENT DOCUMENTS

CN 104 006 626 8/2014
CN 204535232 8/2015
(Continued)

OTHER PUBLICATIONS

International Search Report and Written Report for PCT/CN2016/113663, dated Oct. 11, 2017.
(Continued)

*Primary Examiner* — Joshua K Ihezie
(74) *Attorney, Agent, or Firm* — Justin K. Murray

(57) ABSTRACT

The present invention relates to a skid-mounted cold box and its prefabricated structure and assembly method. Each prefabricated structure includes a framework and a first panel that is used to enclose sides of the framework. Ring beams of two adjacent prefabricated structures are connected through bolts on site. A second panel connected through bolts encloses the gap between ring beams of the two adjacent prefabricated structures from sides. The present invention cancels all field welding seams and omits the field welding and nondestructive testing operations. The crane can be dismissed after the upper prefabricated structure of the cold box is lifted into place and bolts corresponding to columns on ring beams are connected. The present invention guarantees the connection strength of steel structures relying on bolt-based connection between ring beams and the second panel connected through bolts guarantees the
(Continued)

airtightness of the cold box. This effectively reduces field assembly work and saves time and cost.

12 Claims, 6 Drawing Sheets

(51) Int. Cl.

| | |
|---|---|
| ***E04H 5/12*** | (2006.01) |
| ***B65D 71/00*** | (2006.01) |
| ***B65D 90/16*** | (2006.01) |
| *E04B 1/24* | (2006.01) |
| *E04B 1/343* | (2006.01) |

(52) U.S. Cl.
CPC ..... *E04B 1/3483* (2013.01); *E04H 5/12* (2013.01); *E04B 1/34315* (2013.01); *E04B 2001/2418* (2013.01)

(56) References Cited

U.S. PATENT DOCUMENTS

| | | | | |
|---|---|---|---|---|
| 9,285,164 | B2 | 3/2016 | Wilhelm | |
| 10,087,615 | B1 * | 10/2018 | Christie | E04C 3/04 |

FOREIGN PATENT DOCUMENTS

| | | |
|---|---|---|
| CN | 106 223 669 | 12/2016 |
| CN | 205 770 668 | 12/2016 |
| CN | 205 838 941 | 12/2016 |
| DE | 11 03 948 | 4/1961 |
| FR | 2 417 066 | 10/1979 |
| FR | 2 946 075 | 12/2010 |
| JP | 2003 130 296 | 5/2003 |
| WO | WO 2004/005651 | 1/2004 |

OTHER PUBLICATIONS

Search Report and Written Opinion for EP 16 92 5282, dated Jun. 29, 2020.

* cited by examiner

SKID-MOUNTED COLD BOX AND ITS PREFABRICATED STRUCTURE AND ASSEMBLY METHOD

CROSS REFERENCE TO RELATED APPLICATIONS

This application is a § 371 of International PCT Application PCT/CN2016/113663, filed Dec. 30, 2016, which is herein incorporated by reference in its entirety.

FIELD OF THE INVENTION

The present invention relates to a cold box assembly technology, and particularly to a skid-mounted cold box and its prefabricated structure and assembly method.

BACKGROUND OF THE INVENTION

A cold box is a core device of an air separation plant. It includes a thermally insulated box, where a tower and pipes and valves connecting the tower are set. At present, cold boxes are divided into skid-mounted cold boxes and field-assembled cold boxes. For field-assembled cold boxes, parts need to be assembled on site. The workload is heavy, and the assembly quality is easily affected by the construction environment. For skid-mounted cold boxes, most assembly work is completed in a factory workshop where the environment is controlled. The product quality can be guaranteed, and the assembly cycle can be shortened. The two types of cold boxes are designed using the same material or similar materials and the same specification. As shown in FIG. 1 and FIG. 2, a cold box includes a steel structural framework that is composed of parts such as a column 100, a beam 200, an oblique support 300 and an inter-beam support 400, as well as panels that cover all sides of the steel structural framework and enclose the box.

For a skid-mounted cold box, two sections of steel structural framework and their corresponding first panels are generally assembled in a plant and the obtained upper and lower prefabricated structures are transported to the destination site for assembly on site. After the lower prefabricated structure is installed in place, a crane is mobilized to lift the upper prefabricated structure to the specified location so that it can be interconnected with the lower prefabricated structure. Full penetration welding is adopted for joining nodes 101 of the upper and lower columns 100 and nondestructive testing is performed for the welding seams to ensure that the joined columns 100 can vertically run through the cold box and transfer the shear force and bending moment generated by the upper part of the cold box. Then a second panel is connected to the column 100 and the beam 200 near the location where the prefabricated structures are joined, and seal welding is adopted for the joint node of the second panel. After all welding work is complete on site, the crane is dismissed.

Although the existing solution for assembling skid-mounted cold boxes can control the manufacturing and assembly quality of the parts of the prefabricated structures and simplify transportation and lifting, the following issues still exist: more manoeuvre cost and operation time are required for the welding operation on site, for example, columns can be welded only after they are mounted in place and full penetration welding seams must go through non-destructive testing, requiring a long time and a high cost; and considering factors such as overhead work, the quality of welding seams cannot be guaranteed. During welding, the crane needs to stay for the work; when only one cold box is to be installed, it takes a longer time to use large machinery such as a crane, thereby causing low efficiency of its circulation and obviously increasing the cost of use.

TECHNICAL SOLUTION

To solve the issues in the prior art, embodiments the present invention provides a skid-mounted cold box and its prefabricated structure and assembly method, aiming to reduce field assembly work as much as possible while not affecting the connection strength and airtightness of the cold box, so as to save field construction time and cost.

To achieve the foregoing purpose, a technical solution of the present invention provides a skid-mounted cold box prefabricated structure for joining. The structure includes a framework, where multiple columns running through the framework are set, and several first panels connecting to the outer side of the framework, wherein the several first panels form a full enclosure with the framework and outer sides of its columns;

a frame structure that is fixed on the inner side of edges of the first panel at the joining end of the prefabricated structure, where a ring beam is fixed in the frame structure, and mounting holes for bolts are set on the ring beam so that the ring beam can be connected to a similar ring beam of another prefabricated structure for joining through bolts during assembly; and mounting holes for bolts which are set at the joint between the frame structure and the first panel so as to connect a second panel through bolts during assembly, and through the second panel, the gap formed at the two ring beams after an adjacent prefabricated structure is joined is completely enclosed on the outer side of the first panel.

Optionally, the vertical section of the ring beam is I-shaped and has a vertical beam, a joining surface and a non-joining surface and the joining surface and the non-joining surface are fixed on the vertical beam and are parallel to each other; and the vertical section of the frame structure is L-shaped and has a first surface and a second surface that are perpendicular to each other.

The first surface is connected to the inner side of edges of the first panel and mounting holes for bolts are set at the joint so that the second panel can be fixed on the outer side of the first panel through the bolts; and the second surface is connected to the non-joining surface of the ring beam and extends towards the inner side of the framework.

Optionally, a connecting plate is set on the outer side of a location corresponding to a column on the ring beam. The connecting plate extends from the joining surface of the ring beam to the non-joining surface so that the assembled second panel can cover the connecting plate of the ring beam that is joined.

Optionally, mounting holes are set for a first bolt and a second bolt on the joining surface of the ring beam, where the mounting hole for the first bolt is in a location corresponding to a column on the joining surface of the ring beam and the mounting hole for the second bolt is in another location on the joining surface of the ring beam; and the spacing of the mounting hole for the first bolt is smaller than the spacing of the mounting hole for the second bolt.

Optionally, the framework further includes:

several beams set between adjacent columns, where both ends of each beam are connected to corresponding columns;

several inter-beam supports that are parallel to beams and are set between adjacent beams, where both ends of each inter-beam support are connected to corresponding columns; and several oblique supports, where one end of each oblique support is connected to the middle of an inter-beam support and the other end is connected to the joint between a corresponding column and a beam or ring beam.

Another technical solution of the present invention provides a skid-mounted cold box that has two or more prefabricated structures connected through bolts on site.

Any one prefabricated structure includes a framework, where multiple columns running through the framework are set, and several first panels connecting outer sides of the framework, where the several first panels fully enclose the framework and outer sides of its columns;

a frame structure that is fixed on the inner side of edges of the first panel at the joining end of the prefabricated structure; a ring beam is fixed in the frame structure and mounting holes for bolts are set on the ring beam so that the ring beam can be connected to a similar ring beam of another prefabricated structure for joining through bolts during assembly.

Mounting holes for bolts are set on the joint between the frame structure and the first panel so as to connect a second panel through bolts during assembly, and, through the second panel, the gap formed at the two ring beams after an adjacent prefabricated structure is joined on the outer side of the first panel is completely enclosed.

Optionally, in each prefabricated structure, the vertical section of the ring beam is I-shaped and has a vertical beam, a joining surface and a non-joining surface, where the joining surface and the non-joining surface are fixed on the vertical beam and are parallel to each other; the vertical section of the frame structure is L-shaped and has a first surface and a second surface that are perpendicular to each other.

The first surface is connected to the inner side of edges of the first panel and mounting holes for bolts are set at the joint so that the second panel can be fixed on the outer side of the first panel through the bolts. The second surface is connected to the non-joining surface of the ring beam and extends towards the inner side of the framework.

Optionally, on two adjacent prefabricated structures, a connecting plate is set on the outer side of the location corresponding to a column on each ring beam. The connecting plate extends from the joining surface of the ring beam to the non-joining surface so that the assembled second panel can cover the outer side of the connecting plates for the two prefabricated structures that are joined.

Optionally, a washer made of neoprene is set between the second panel and the first panel.

Optionally, bolts connecting ring beams in two adjacent prefabricated structures are friction-type high-strength bolts; and the spacing of the bolt in a location corresponding to a column on the joining surface of any ring beam is smaller than the spacing of bolts in other locations on the joining surface of the ring beam.

Optionally, any one prefabricated structure further includes:

several beams that are set between adjacent columns, where both ends of each beam are connected to corresponding columns;

several inter-beam supports that are parallel to beams and are set between adjacent beams, where both ends of each inter-beam support are connected to corresponding columns; and several oblique supports, where one end of each oblique support is connected to the middle of an inter-beam support and the other end is connected to the connecting part of a corresponding column and beam or ring beam.

Another technical solution of the present invention provides a method for assembling the skid-mounted cold box. The method includes the following process:

transporting the upper and lower prefabricated structures of the cold box to the predetermined site;

installing the lower prefabricated structure;

mobilizing a crane to lift the upper prefabricated structure so that the joining surfaces of ring beams of the upper and lower prefabricated structures are aligned and in contact;

installing and fastening bolts in locations corresponding to columns on the joining surfaces of the ring beams and selectively dismissing the crane;

installing and fastening bolts in other locations on the joining surfaces of the ring beams and completing framework connection of the upper and lower prefabricated structures; and connecting the second panel to the outer side of the first panel for the upper and lower prefabricated structures through bolts and completely enclosing the gap formed in ring beams of the upper and lower prefabricated structures that are joined through the second panel.

Compared with the prior art, the skid-mounted cold box according to the present invention and its prefabricated structure and assembly method have the following advantage: the present invention can cancel all field welding seams without the need to weld columns or panels on site during field joining, which avoids nondestructive testing for columns, reduces field assembly work and saves testing time for relevant facilities and facility fees.

The skid-mounted cold box according to the present invention guarantees the strength of framework joints by connecting bolts for ring beams between adjacent prefabricated structures. Once the ring beams of the upper and lower prefabricated structures are aligned and bolts corresponding to columns are fastened on the joining surface, the crane can be dismissed. This saves the time required for field assembly and the measure cost to the maximum extent.

The framework of the prefabricated structure and the first panel according to the present invention are manufactured and assembled in a plant in a high-quality manner and the first panel provides good airtight effect for all frameworks and their columns. During field assembly, the second panel is connected through bolts to cover the gap formed between two ring beams from the outer side of the first panel after adjacent prefabricated structures are joined. In addition, a washer is set on the contact surface between the second panel and the first panel to effectively guarantee the airtightness of the cold box.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

DETAILED DESCRIPTION OF THE EMBODIMENTS

The following describes specific embodiments of the present invention in combination with FIG. 3 to FIG. 6.

The present invention provides a skid-mounted cold box and its prefabricated structure and assembly method to cancel all field welding operations for joining nodes. Adjacent prefabricated structures in the skid-mounted cold box are reliably connected by connecting bolts. The following takes the upper and lower prefabricated structure as an example. However, the present invention is not limited in other examples. More than two prefabricated structure of the cold box can be designed depending on actual requirements.

Figure 1:
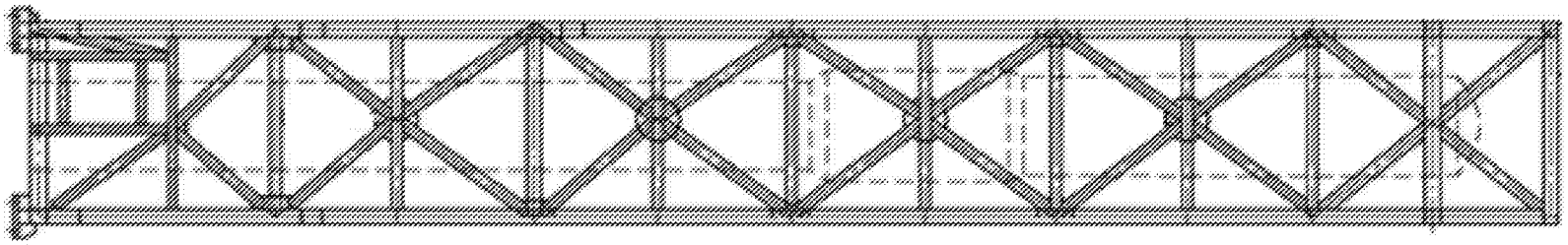
FIG. 1 is a schematic diagram of the steel structural framework of a cold box in the prior art.
Figure 2:
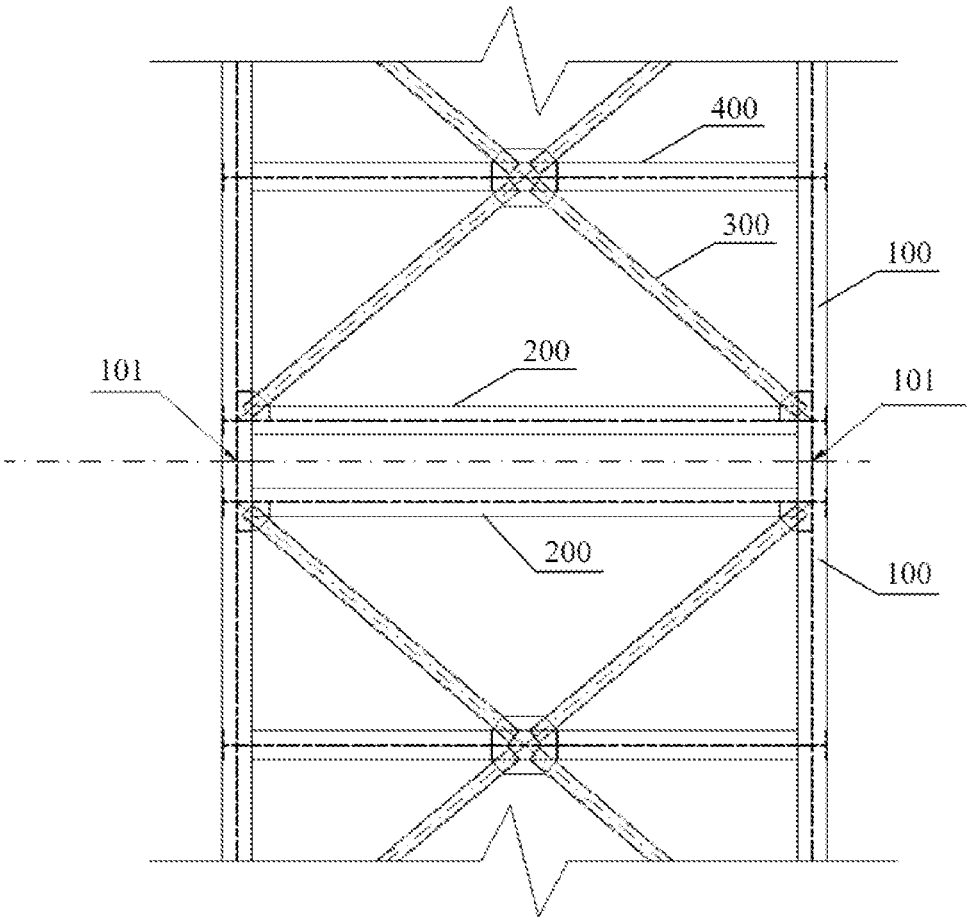
FIG. 2 is a schematic diagram of joining locations for a cold box in the prior art.
Figure 3:
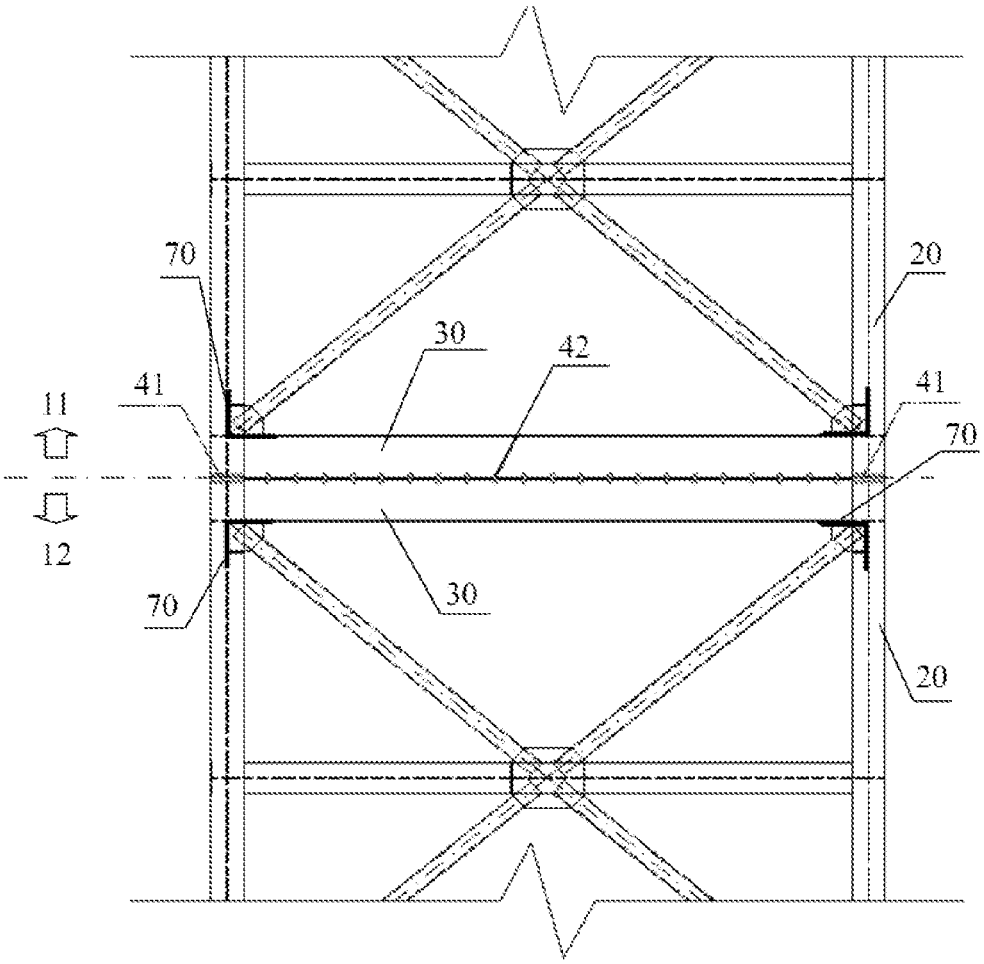
FIG. 3 is a side view of the joined prefabricated structure framework of the skid-mounted cold box according to the present invention.
Figure 4:
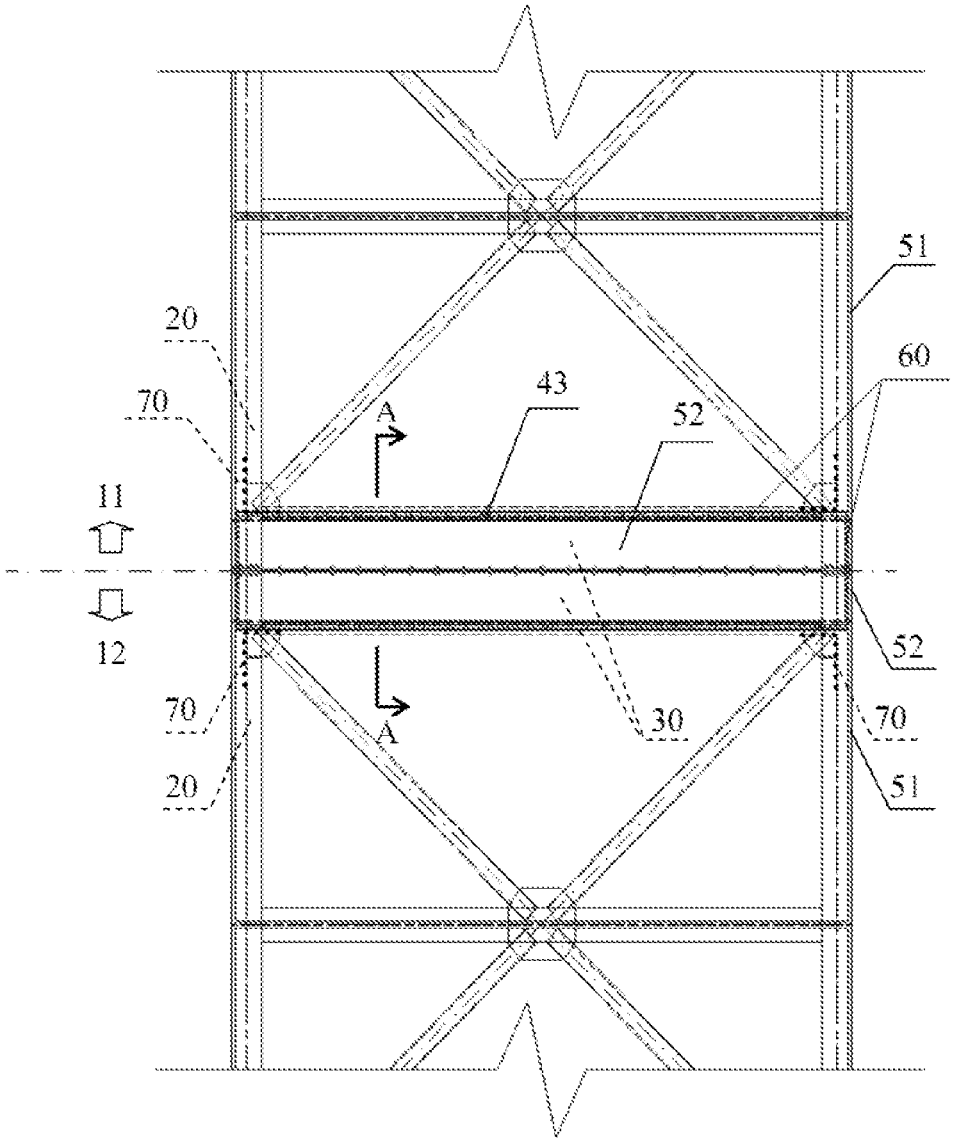
FIG. 4 is a schematic diagram of the connection of the second panel in the skid-mounted cold box according to the present invention.

As shown in FIG. 3 and FIG. 4, any prefabricated structure of the skid-mounted cold box according to the present invention includes a steel structural framework that is composed of parts such as column 20, beam, oblique support, inter-beam support and ring beam 30, as well as several first panels 51 that cover outer sides of the framework to completely enclose the outer sides of the framework and its columns 20.

In the cold box where the cross section is square, the framework of each prefabricated structure has four columns 20 that run through the framework. Multiple beams are set between adjacent columns 20 and both ends of each beam are connected to a corresponding column 20. Inter-beam supports that are parallel to beams are set between adjacent beams and both ends of an inter-beam support are connected to a corresponding column 20. One end of each oblique support is connected to the middle of an inter-beam support to form a cross-shaped structure and the other end of the oblique support is connected to the joint between a corresponding column 20 and a beam or ring beam 30.

The ring beam 30 is located at the joining end of a prefabricated structure, for example, the bottom of an upper prefabricated structure 11 and top of a lower prefabricated structure 12. At the joining end of each prefabricated structure, a steel frame structure 70 is set to make the frame structure 70 be fixed on the inner side of a first panel 51 of the framework and surround the outer sides of columns 20. The ring beam 30 is connected and fixed on the frame structure 70 to form a continuous entirety. The direction of the joining end of each prefabricated structure is different. Therefore, the joining surface of the ring beam 30 is its bottom or top. The top or bottom of the ring beam 30 opposite to the joining surface is called the non-joining surface.

Figure 6:
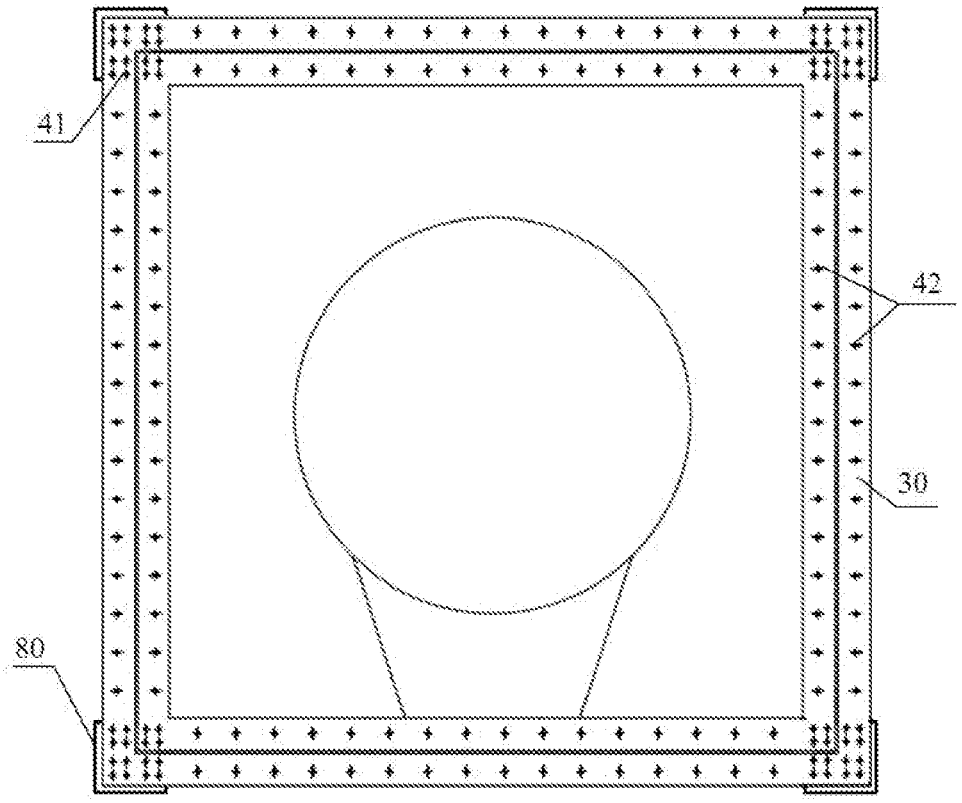
FIG. 6 is a schematic diagram of the joining surface of a ring beam according to the present invention.

In reference to FIG. 3 and FIG. 6, mounting holes are set on the joining surface of each ring beam 30 to install a first bolt 41 and a second bolt 42 during field assembly and connect ring beams 30 of adjacent prefabricated structures. The first bolt 41 is installed in a location (for example, a corner) corresponding to a column 20 on the joining surface of the ring beam 30 and the second bolt 42 is installed in another location on the joining surface of the ring beam 30. The spacing of the first bolt 41 is smaller than the spacing of the second bolt 42.

On the outer side of the location corresponding to a column 20 on the ring beam 30, a connecting plate 80 is set. Each connecting plate 80 extends from the joining surface of the ring beam 30 to the non-joining surface. The connecting plates 80 of two adjacent prefabricated structures may contact each other after they are joined but do not need to be fixed through welding or bolts.

Figure 5:
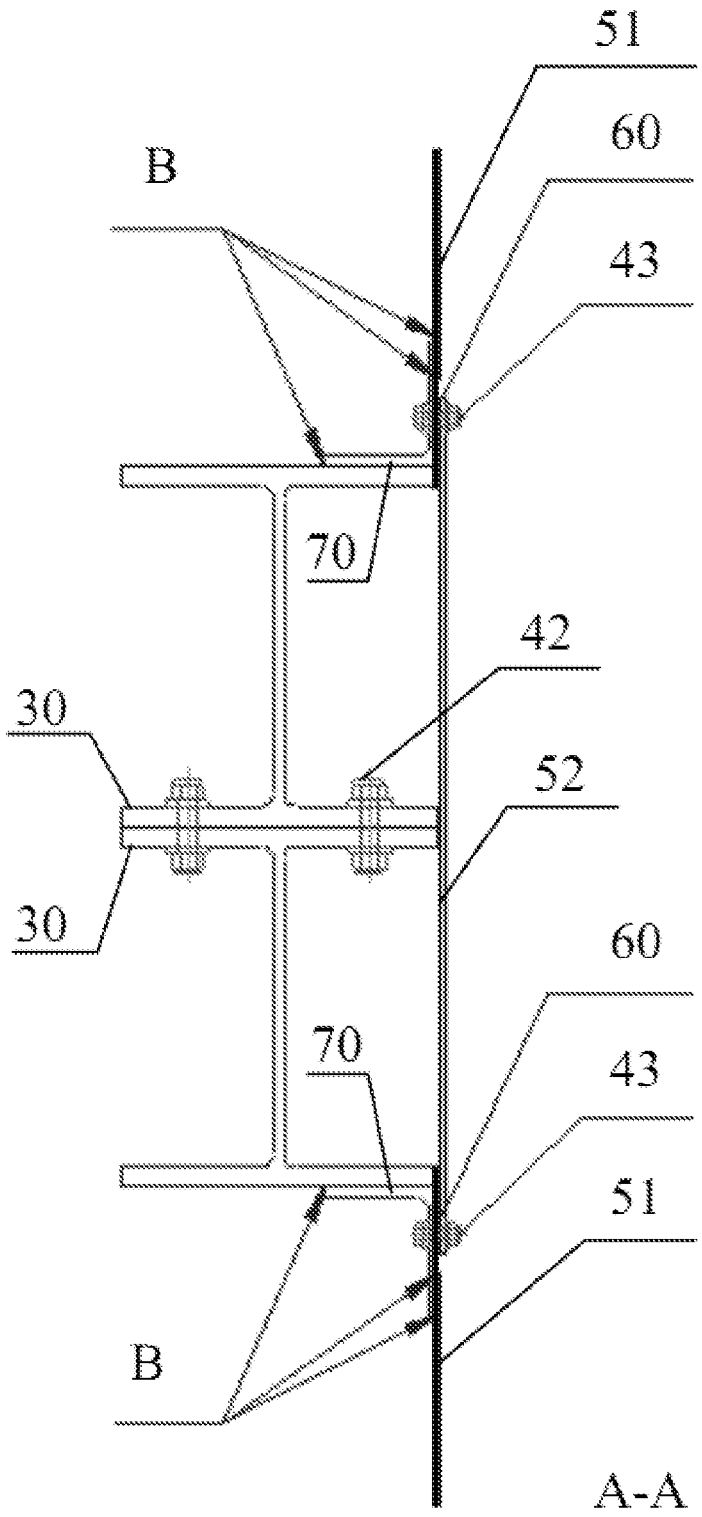
FIG. 5 is a schematic diagram of the connection of the panel and ring beam in the A-A vertical section shown in FIG. 4.

In a factory workshop, all sides of frameworks of prefabricated structures are enclosed through several first panels 51 connected with parts such as beams and columns. The joining node of the first panel 51 may adopt seal welding to ensure the airtightness. Take the vertical section A-A shown in FIG. 5 as an example. The vertical section on any side of the ring beam 30 is I-shaped and a vertical beam is set to fix the joining surface and non-joining surface that are parallel to each other. The vertical section on any side of the frame structure 70 is L-shaped and has a first surface and a second surface that are perpendicular to each other. The first surface of the frame structure 70 is welded on the inner side of edges of a first panel 51 and the second surface of the frame structure 70 is welded on the non-joining surface of the ring beam 30 and extends towards the inner side of the framework. The first surface of the frame structure 70 is basically aligned with the outer edge of the non-joining surface. In FIG. 5, B indicates that the frame structure 70 is connected to the first panel 51 and ring beam 30 through welding.

Each first panel 51 preferably covers the first surface of the frame structure 70 completely. At the welding point between the first surface of the frame structure 70 and the first panel 51, a mounting hole that runs through the two is set and is used to install a third bolt 43 for connecting the second panel 52. A washer 60 made of neoprene is set between the second panel 52 and the first panel 51 during field assembly. The second panel 52 can cover outer sides of connecting plates 80 (shown in FIG. 6) of two ring beams 30 after field joining is complete. The two ring beams 30 are fixed and connected through the first bolt 41 and second bolt 42 installed on the joining surface.

The foregoing parts of prefabricated structures are connected through welding or bolts in a factory workshop according to design requirements and necessary quality testing is performed for finished products of the parts. Assuming the cross section of a framework is in another shape, for example, hexagon, the number of parts such as beams, columns and panels can be increased accordingly. This is not described here in detail.

The following describes the process of assembling a skid-mounted cold box on site:

As shown in FIG. 3, upper and lower prefabricated structures 11 and 12 are transported to the predetermined site. After the lower prefabricated structure 12 is installed in place, a crane is mobilized to lift the upper prefabricated structure 11, making the joining surfaces of ring beams 30 of the upper and lower prefabricated structure 11 and 12 be aligned and in contact. After the first bolt 41 is installed and fastened in a location corresponding to a column 20 on the surface of the ring beam 30, the crane can be dismissed (or stay on site). Then in another location on the joining surface of the ring beam 30, the second bolt 42 is installed and fastened. The frameworks of adjacent prefabricated structures according to the present invention are reliably connected through ring beams 30 connected based on bolts. The ring beams 30 are made of carbon steel. The first bolt 41 and the second bolt 42 for the ring beam 30 are friction-type high-strength bolts and are used to ensure that relative displacement does not occur between prefabricated structures under the action of wind load. The shear force and bending moment generated by the upper prefabricated structure 11 can be transferred to the prefabricated structure 12 under the joint action of the column 20 and ring beam 30 to further enhance the structural stiffness of frameworks.

After frameworks are connected, as shown in FIG. 4 and FIG. 5, each second panel 52 is connected to two prefabricated structures through the second bolt 43 and the second panel 52 is connected to the outer side of the first panel 51 and corresponds to the welding point between the first surface of the frame structure 70 and the first panel 51. Through the second panel 52, the gap formed between two ring beams 30 after the upper and lower prefabricated structures 11 and 12 are joined is enclosed from the outer side of the second panel. A washer 60 made of neoprene is set between the second panel 52 and the first panel 51.

Meanwhile, edges of the connecting plates 80 of two ring beams 30 are adjacent or in contact and the second panel 52 directly covers the outer side of the two connecting plates 80 to enclose the gap (corresponding to the gap in corresponding locations of columns 20 on the two ring beams 30) between edges of the two connecting plates 80. Now, the prefabricated structures of the skid-mounted cold box are joined and assembled on site.

In an example of a cold box with a design height of 30 m, sizes can be designed for parts such as columns, beams, oblique supports and inter-beam supports according to general requirements. The ring beam 30 is I-shaped on any side and the width of the joining surface and non-joining surface is equal to the height of vertical beams. The height is 350 mm to 400 mm and is preferably 350 mm. Compared with a traditional cold box joined on site or a skid-mounted cold box, ring beams 30 are set in the upper and lower prefabricated structures 11 and 12 in the example. This causes little change to the overall height of the cold box after assembly. In reference to FIG. 6, first bolts 41 on the joining surfaces of ring beams 30 corresponding to columns 20 are densely set. In this example, 16 first bolts 41 are installed in a corner of a ring beam 30. The spacing (200 to 300 mm in this example) of second bolts 42 installed in other locations of the joining surfaces of ring beams 30 is greater than the spacing of first bolts 41 installed in corners. When each side of a framework is connected to a second panel 52, the height after the upper and lower ring beams 30 are joined is smaller than the height of the second panel 52 on the side so that the top and bottom of the second panel 52 that is connected can be respectively located above the non-joining surface of the upper ring beam 30 and below the non-joining surface of the lower ring beam 30. This avoids joining nodes of beams and columns and guarantees better airtightness.

To sum up, the present invention can effectively avoid welding of steeling structures and nondestructive testing during field joining and save relevant costs. When bolts are used for joining, once the upper prefabricated structure of the cold box is in place and the bolts corresponding to columns on ring beams are connected and fastened, the crane can be dismissed. The present invention guarantees sufficient strength relying on bolt-based connection between ring beams and saves field time and measure cost to the maximum extent. In the present invention, the second panel is connected through bolts to cover the gap formed between two ring beams after joining. In addition, a washer is set on the contact surface between the second panel and the first panel to guarantee the airtightness of the cold box.

Although the content of the present invention is described in detail through the preferred embodiments, the description should not be considered as limitations to the present invention. After persons skilled in the art read the content, modifications and substitutions of the present invention are apparent to the persons. Therefore, the protection scope of the present invention should be limited by the Claims attached below.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A skid-mounted cold box prefabricated structure comprising a framework, wherein multiple columns running through the framework are set, and several first panels connecting an outer side of the framework, wherein the several first panels fully enclose the framework and outer sides of the multiple columns;

a frame structure that is fixed on an inner side of edges of the first panels at a joining end of the prefabricated structure, wherein a ring beam is fixed and mounting holes for bolts are set on the ring beam so that the ring beam can be connected to a similar ring beam of another prefabricated structure for joining through bolts during assembly; and mounting holes for bolts are set at the joint between the frame structure and the first panel so as to connect a second panel through bolts during assembly, and through the second panel, a gap formed at the two ring beams after an adjacent prefabricated structure is joined is completely enclosed on an outer side of the first panel.

2. The skid-mounted cold box prefabricated structure according to claim 1, wherein:

a vertical section of the ring beam is I-shaped and has a vertical beam, a joining surface and a non-joining surface, the joining surface and the non-joining surface are fixed on the vertical beam and are parallel to each other, and a vertical section of the frame structure is L-shaped and has a first surface and a second surface that are perpendicular to each other; and the first surface is connected to the inner side of edges of the first panel, mounting holes for bolts are set at the joint so that the second panel can be fixed on the outer side of the first panel through the bolts, and the second surface is connected to the non-joining surface of the ring beam and extends towards an inner side of the framework.

3. The skid-mounted cold box prefabricated structure according to claim 2, wherein a connecting plate is set on an outer side of a location corresponding to a column on the ring beam and the connecting plate extends from the joining surface of the ring beam to the non-joining surface so that the assembled second panel can cover the connecting plate of the ring beam that is joined.

4. The skid-mounted cold box prefabricated structure according to claim 1, wherein:

mounting holes are set for a first bolt and a second bolt on the joining surface of the ring beam, the mounting hole for the first bolt is in a location corresponding to a column on the joining surface of the ring beam and the mounting hole for the second bolt is in another location on the joining surface of the ring beam; and a spacing of the mounting hole for the first bolt is smaller than the spacing of the mounting hole for the second bolt.

5. The skid-mounted cold box prefabricated structure according to claim 1, wherein the framework further comprises:

several beams that are set between adjacent columns, wherein both ends of each beam are connected to corresponding columns;

several inter-beam supports that are parallel to beams and are set between adjacent beams, wherein both ends of each inter-beam support are connected to corresponding columns; and several oblique supports, wherein one end of each oblique support is connected to the middle of an inter-beam support and the other end is connected to a joint between a corresponding column and a beam or ring beam.

6. A skid-mounted cold box, wherein the skid-mounted cold box has two or more prefabricated structures connected through bolts on site;

any one prefabricated structure comprises a framework, wherein multiple columns running through the framework are set, and several first panels connecting outer sides of the framework, wherein the several first panels fully enclose the framework and outer sides of its columns;

a frame structure that is fixed on an inner side of edges of the first panel at a joining end of the prefabricated structure, wherein a ring beam is fixed and mounting holes for bolts are set on the ring beam so that the ring beam can be connected to a similar ring beam of another prefabricated structure for joining through bolts during assembly; and mounting holes for bolts are set at the joint between the frame structure and the first panel so as to connect a second panel through bolts during assembly, and through the second panel, a gap formed at the two ring beams after an adjacent prefabricated structure is joined is completely enclosed on an outer side of the first panel.

7. The skid-mounted cold box according to claim 6, wherein: in each prefabricated structure, a vertical section of the ring beam is I-shaped and has a vertical beam, a joining surface and a non-joining surface, the joining surface and the non-joining surface are fixed on the vertical beam and are parallel to each other, and a vertical section of the frame structure is L-shaped and has a first surface and a second surface that are perpendicular to each other; and the first surface is connected to the inner side of edges of the first panel, mounting holes for bolts are set at the joint so that the second panel can be fixed on the outer side of the first panel through the bolts, and the second surface is connected to the non-joining surface of the ring beam and extends towards an inner side of the framework.

8. The skid-mounted cold box according to claim 7, wherein on two adjacent prefabricated structures, a connecting plate is set on an outer side of the location corresponding to a column on each ring beam and the connecting plate extends from the joining surface of the ring beam to the non-joining surface so that the assembled second panel can cover outer sides of the connecting plates for the two prefabricated structures that are joined.

9. The skid-mounted cold box according to claim 6, wherein a washer made of neoprene is set between the second panel and the first panel.

10. The skid-mounted cold box according to claim 7, wherein bolts connecting ring beams in two adjacent prefabricated structures are friction-type high-strength bolts; and a spacing of the bolt in a location corresponding to a column on the joining surface of any one ring beam is smaller than a spacing of bolts in other locations on the joining surface of the ring beam.

11. The skid-mounted cold box according to claim 6, wherein any one prefabricated structure further comprises:

several beams that are set between adjacent columns, wherein both ends of each beam are connected to corresponding columns;

several inter-beam supports that are parallel to beams and are set between adjacent beams, wherein both ends of each inter-beam support are connected to corresponding columns; and several oblique supports, wherein one end of each oblique support is connected to a middle of an inter-beam support and the other end is connected to the joint between a corresponding column and a beam or ring beam.

12. A method for assembling the skid-mounted cold box according to claim 6, the method comprising the steps of:

transporting upper and lower prefabricated structures of the cold box to the predetermined site;

installing the lower prefabricated structure;

lighting the upper prefabricated structure so that joining surfaces of ring beams of the upper and lower prefabricated structures are aligned and in contact;

installing and fastening bolts in locations corresponding to columns on the joining surfaces of the ring beams;

installing and fastening bolts in other locations on the joining surfaces of the ring beams and completing framework connection of the upper and lower prefabricated structures; and connecting the second panel to the outer side of the first panel for the upper and lower prefabricated structures through bolts and completely closing the gap formed in ring beams of the upper and lower prefabricated structures that are joined through the second panel.

* * * * *